United States Patent [19]

De Nora et al.

[11] 3,930,981

[45] Jan. 6, 1976

[54] BIPOLAR ELECTROLYSIS CELLS WITH PERFORATE METAL ANODES AND BAFFLES TO DEFLECT ANODIC GASES AWAY FROM THE INTERELECTRODIC GAP

[75] Inventors: Oronzio De Nora, Milan, Italy; Vittorio De Nora, Nassau, Bahamas

[73] Assignee: Oronzio De Nora Impianti Elettrochimici S.p.A., Milan, Italy

[22] Filed: June 24, 1974

[21] Appl. No.: 482,319

[30] Foreign Application Priority Data

June 25, 1973 Italy ..... 25775/73

[52] U.S. Cl. ..... 204/256; 204/266; 204/270; 204/278; 204/283; 204/284; 204/290 F

[51] Int. Cl.[2] ..... C25B 11/03; C25B 11/08; C25B 11/10

[58] Field of Search ..... 204/256, 266, 258, 268, 204/270, 278, 283, 284, 128, 98

[56] References Cited

UNITED STATES PATENTS

| | | | |
|---|---|---|---|
| 1,771,091 | 7/1930 | Lawaczeck | 204/283 |
| 3,676,315 | 7/1972 | Goens et al. | 204/284 |
| 3,809,630 | 5/1974 | Denora et al. | 204/283 |

FOREIGN PATENTS OR APPLICATIONS

| | | | |
|---|---|---|---|
| 2,059,868 | 6/1971 | Germany | 204/284 |

*Primary Examiner*—R. L. Andrews
*Attorney, Agent, or Firm*—Hammond & Littell

[57] ABSTRACT

Describes electrolysis diaphragm cells with substantially vertical, dimensionally stable, valve metal anodes and steel cathodes forming substantially vertical interelectrodic gaps therebetween with grooved, slotted, reticulated or rod type anodes and baffles on either the front or back, or on both the front and back, of said anodes to direct the anodic gases away from the interelectrodic gap, and slots or other openings in the anodes, adjacent said baffles, through which the anodic gases pass to the rear of the anodes, to thereby protect the diaphragms against destruction by the anodic gases produced in the interelectrodic gap.

22 Claims, 13 Drawing Figures

BIPOLAR ELECTROLYSIS CELLS WITH PERFORATE METAL ANODES AND BAFFLES TO DEFLECT ANODIC GASES AWAY FROM THE INTERELECTRODIC GAP

This invention relates to a gas control means for gas producing electrolysis cells and to a method of controlling gases, especially in diaphragm containing electrolysis cells, equipped with dimensionally stable anodes, to remove the anodic gases from the interelectrodic gap and to prevent disturbance or destruction of the diaphragm by the gases released during the electrolysis process, whereby current efficiency is improved and cell voltage is lowered.

It is applicable to cells for the production of halogen gases from alkali metal halides, to the production of hydrogen and oxygen from water, to the production of chlorates, hypochlorites, to HCl electrolysis and to other electrolysis processes in which a gas is released at the anode or the cathode.

When vertical or substantially vertical anodes and cathodes are used in electrolysis processes and cells, the gas bubbles rise in the interelectrodic gap between the anodes and cathodes and travel toward the top of the gap. As the gas bubbles approach the top of the cell, the accumulation of bubbles is so great that the current efficiency is greatly reduced and the agitation toward the top of the cell tends to destroy the diaphragms. This gas bubble accumulation toward the top of the anodes has heretofore severely limited the height of vertically arranged anodes and cathodes, because if anodes beyond about one meter in height were used, the amount of gas bubbles in the electrolyte toward the top of the gap was so great as to virtually stop the flow of electrolysis current through the top portion of the gap. This invention overcomes this problem by passing the gases released at the anode through the anode and deflecting the gases away from the anode faces and from the interelectrodic gap and into the electrolyte space behind the active face of the anodes.

Also in cells of this type, the height of the cell has been limited to about one meter because of the accumulation of gases in the interelectrodic gap and because of the destruction of the diaphragms near the top of the one meter high cells. However, if deflecting baffles are used approximately every 2/3 rd meter along the interelectrodic gap, so that the gases are deflected away from the gap, the height of these cells can be increased to two or four meters or higher.

DEFINITIONS

The term "dimensionally stable anodes" as used herein is intended to describe metal anodes formed from valve metals such as titanium, tantalum, zirconium, molybdenum, niobium and tunsten and alloys thereof, carrying an electrically conducting electrocatalytic coating thereon capable of conducting current to the electrolyte over long periods of time without becoming passivated and in the production of chlorine capable of catalyzing the formation of chlorine molecules from the chloride ions released in a chloride electrolysis process. Typical electrical conducting electrocatalytic coatings contain gold, silver, platinum, palladium, iridium, ruthenium, osmium, rhodium, iron (magnetite), nickel, chromium, copper, lead, manganese or mixtures thereof in the metallic state or as oxides, nitrides, carbides and sulfides of these metals. Other electrocatalytic coatings may be used.

The "front" or "face" of the anodes is the surface of the anodes facing the cathodes and forming one wall of the interelectrodic gap — the other wall being the cathode.

The "back" or "rear" of the anodes is the other side of the anodes, away from the cathodes.

This invention is useful in all forms of electrolysis processes and cells using vertically arranged dimensionally stable anodes and cathodes which have passages through which the electrolyte and gases may pass from the front to the back of the anodes and baffles to deflect the gases through the anodes and into the electrolyte to the rear of the anodes.

It is especially useful in apparatus and processes in which dimensionally stable anodes are used with diaphragms to separate the electrolysis products. These diaphragms are usually made of asbestos fibers or flock deposited from solution on the cathode screens or from woven asbestos cloth. The diaphragms must be porous enough for the electrolyte to flow through them, under the pressure head maintained between the anolyte and catholyte and, hence, the asbestos fiber must be loosely woven or deposited, to provide the desired porosity. The diaphragms are usually maintained in place against the cathode screens by the pressure differential (pressure head) between the anolyte and catholyte and have little mechanical strength. The gases produced during the electrolytic process and rising along the surfaces of the diaphragms, however, disturb the asbestos fibers carrying away portions of the fibers and, hence, gradually eroding and destroying the diaphragms to the extent that the cell must be dismantled and new diaphragms applied.

When dimensionally stable metal anodes are used with diaphragm covered cathodes in electrolysis cells, it is desirable that both the anodes and the cathodes have a long life so that dismantling the cells to replace diaphragms or to replace worn or passivated anodes becomes largely unnecessary.

The accumulation of gas bubbles in the interelectrodic gap, particularly toward the top of a vertically arranged gap, reduces the conductivity of the electrolyte at this point, thereby increasing the voltage drop across the gap and also causes greater destruction of the diaphragms toward the top of the interelectrodic gap.

OBJECTS

One of the objects of this invention is to provide dimensionally stable valve metal anodes which will deflect the rising gases away from the face of the anode and away from the interelectrodic gap, to prevent accumulation of gas bubbles in the top of the interelectrodic gap and prevent disturbance of the diaphragms by the rising gas bubbles.

Another object of the invention is to provide dimensionally stable valve metal anodes which are grooved or slotted, reticulated or rod shaped and which will promote the flow of anodic gases vertically along the grooved or spaced rod surfaces and divert the gases away from the interelectrodic gap between the anode and the cathode.

Another object of the invention is to provide vertically mounted or slightly inclined grooved, reticulated or rod type dimensionally stable valve metal anodes with deflectors which will deflect rising anodic gases away from the interelectrodic gap between the anodes and the cathodes, and with slots or passages through the anodes adjacent these deflectors or baffles, to prevent mixing or remixing of the anodic and cathodic products, and in cells having diaphragms, prevent disturbance and erosion of the diaphragms by the rising anodic gases. Deflectors may also be provided on the cathode screens.

Another object of this invention is to provide dimensionally stable valve metal anodes with means to automatically deflect vertically rising gas bubbles produced at the anodes of an electrolysis cell through perforations, slots or holes in the anodes and away from the interelectrodic gap between the anodes and cathodes of an electrolysis cell, so that the conductivity of the electrolyte in said gap is not diminished by the accumulation of gas bubbles near the top of said gap and destruction of the diaphragms is reduced.

Another object of this invention is to provide a bipolar electrolysis cell with hollow wave shaped anodes and cathodes, with deflectors on the anodes to deflect gases out of the interelectrodic gap and into the hollow space behind the anodes and away from the anodes, whereby the above recited objects are accomplished.

Another object is to provide an electrolysis cell and a method of operating said cell which will realize the above described improvements.

Various other objects and advantages of the invention will appear as this description proceeds.

The accompanying drawings show only simplified embodiments of the invention, which can take many other forms than those specifically illustrated.

Figures 5, 9:
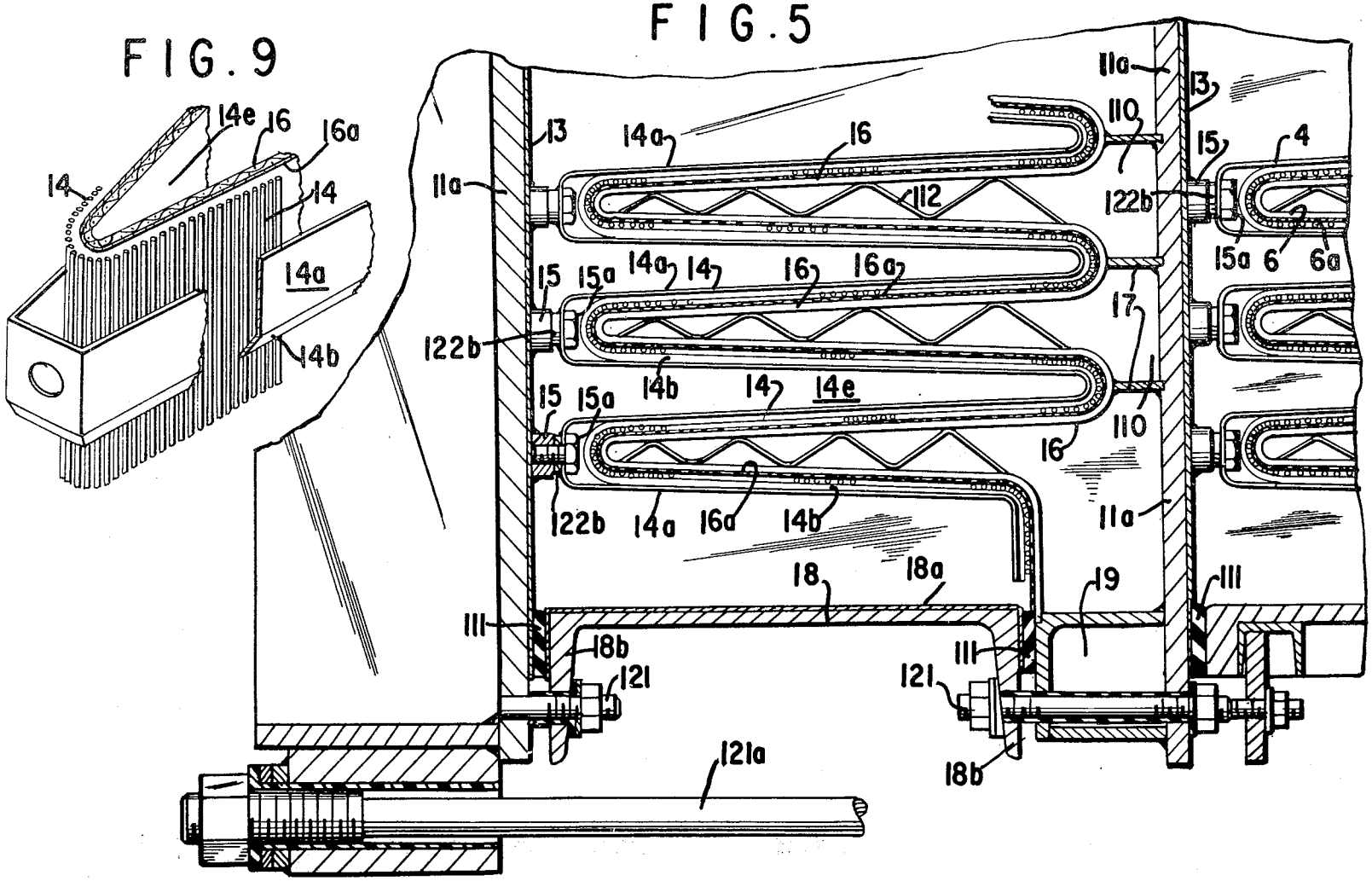
FIGS. 5 and 6 are detail cross sectional plan views of modifications of the new anode described herein.
FIG. 9 is a partial perspective view of a vertical rod anode with baffles to pass gases through and away from the anode.
Figure 6:
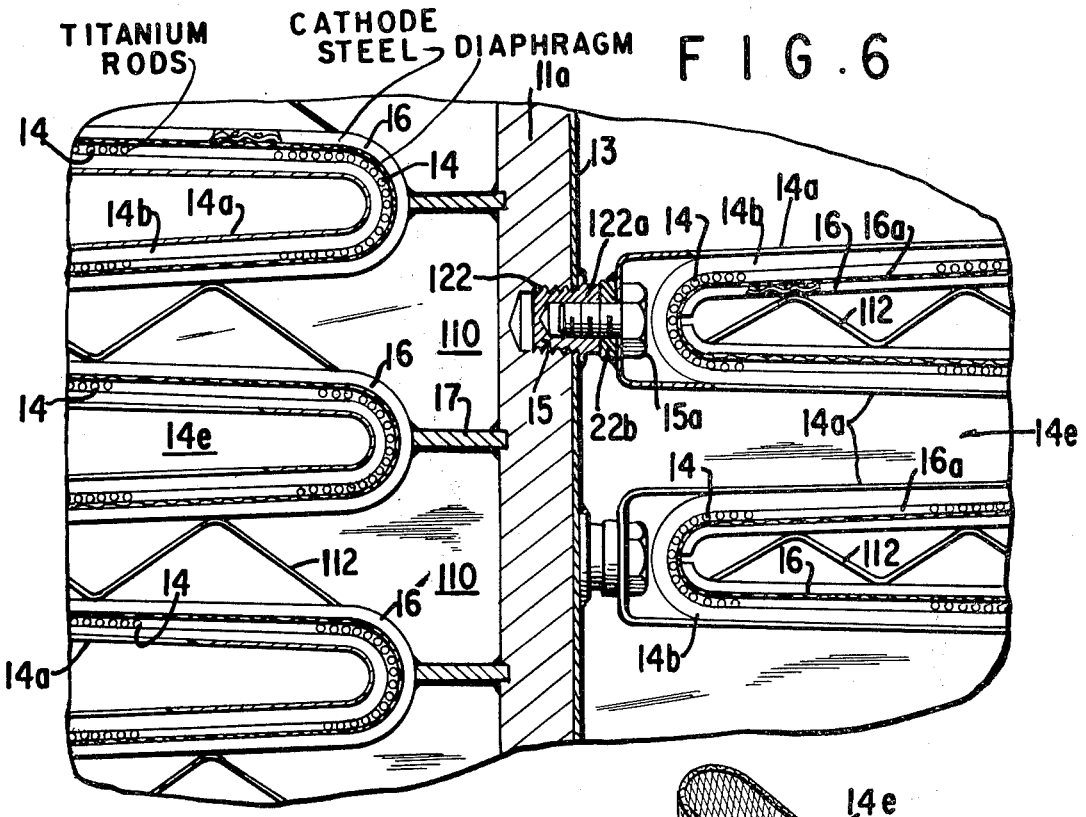
Figure 7:
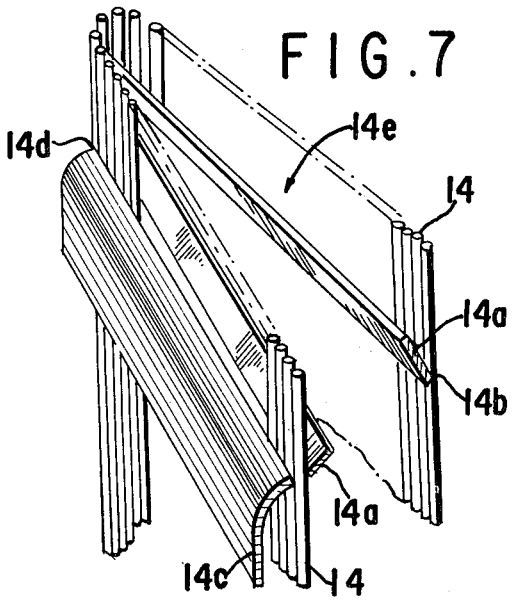
FIGS. 7 and 8 are perspective views of rod and mesh anodes, respectively, having deflectors in both the front and back of the anode and having slots or other openings to pass the anodic gases from the front to the back of the anodes.
Figure 8:
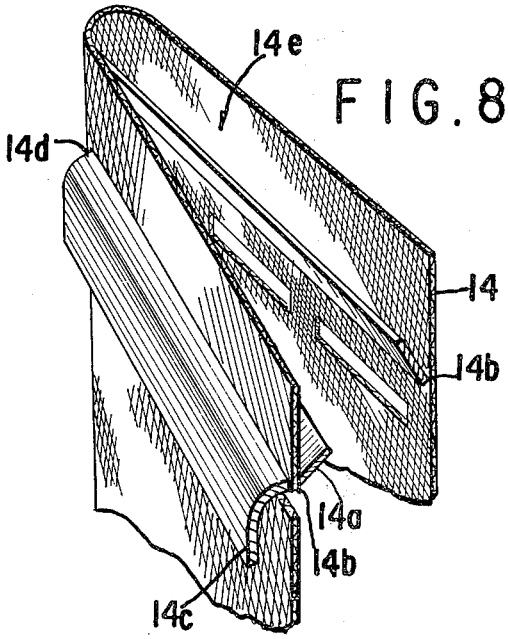

FIGS. 1 to 9 illustrate a three unit bipolar cell having a terminal positive end unit B, and intermediate unit C and a terminal negative end unit D. Only one intermediate unit C has been illustrated, but it will be understood that any number of intermediate units C, C, etc. may be used. The unit B consists of a positive (anode) end plate 11, preferably of steel, to which the positive electrical connections 12 are secured. The plate 11 is provided with a titanium, tantalum or other valve metal lining 13, which is resistant to the electrolyte and the electrolysis conditions encountered in the cell and the anodes 14 in rod or other forms are supported on baffle bars 14*a* (FIGS. 2,4,5,6 and 7) and connected to the titanium lining by titanium connectors 15, illustrated in greater detail in FIGS. 5 and 6, which insure good electrical connections between the titanium linings 13, end plate 11 and the anode rods 14 or other forms of anodes. The plates 11*a* and 13 between the end units B and the intermediate units C,C and end unit D from a bimetallic partition between these cell units, said partitions having valve metal 13 on the anodic side and steel or other ferrous metal 11*a* on the cathode side. The titanium or other valve metal lining 13 is secured to the plates 11 and 11*a* by sandwich welding, using intermediate sandwich metals if necessary, or by bolting or vacuum held connection or any other connection which insures a good metal to metal electrical contact between the catholyte resisting plates 11, 11*a*, etc. and the anolyte resisting valve metal lining plates 13. Similar bimetallic plates 11*a* and 13 constituting the bipolar connection between cell units B and C,C and D, etc., are provided between each unit of the bipolar cell. Titanium, tantalum or other valve metals or alloys of these metals may be used for the lining 13, the anode rods 14 and the baffle bars 14*a* and 14*c* (FIGS. 7 and 8). Only the anode rods or faces 14 are provided with an electrocatalytic coating. The anodes and cathodes shown in FIGS. 1 to 9 are in hollow wave or finger form, nested together as shown, to provide a large anode and cathode area in a small space.

Figure 1:
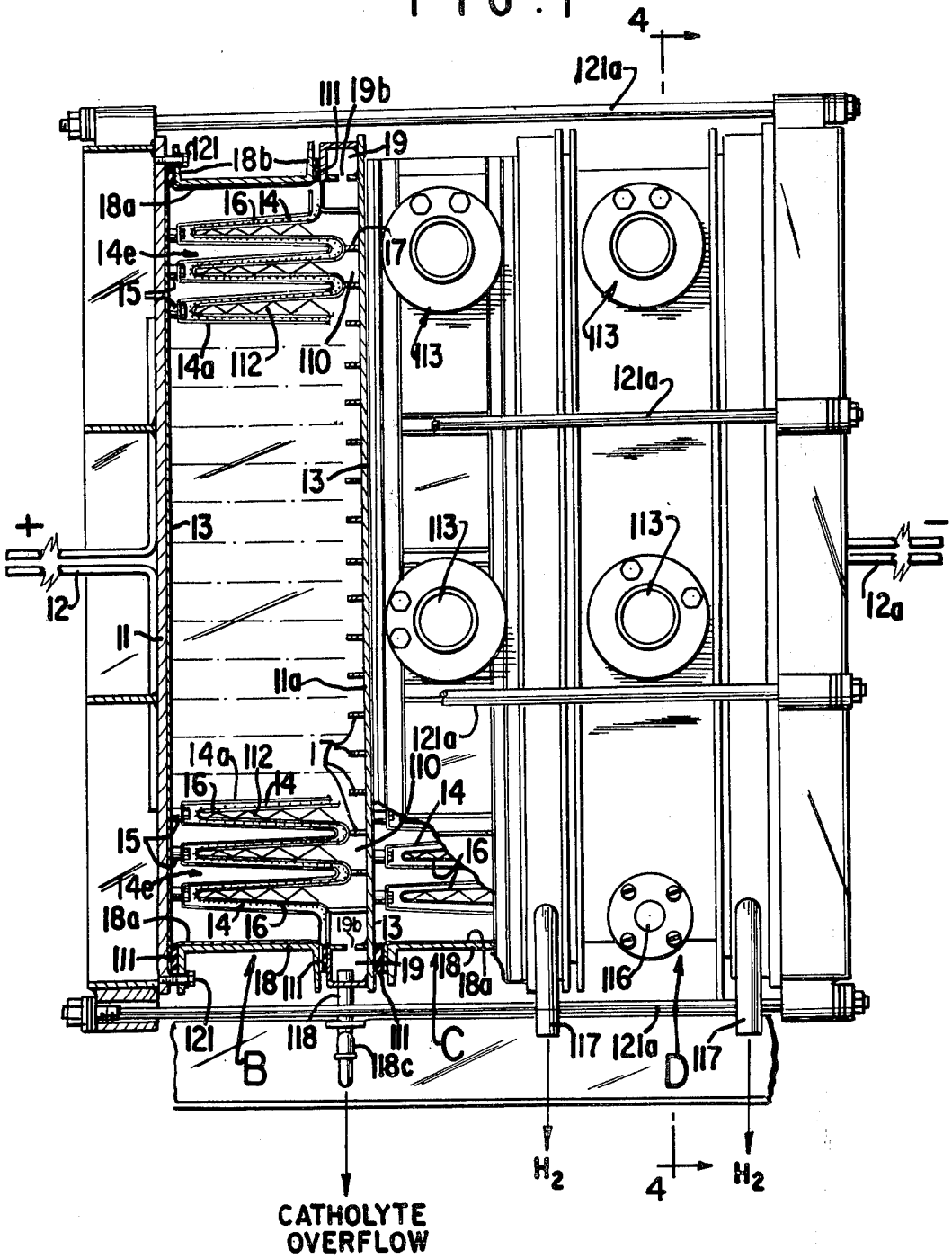
FIG. 1 is a plan view with parts broken away, of a three unit bipolar cell having dimensionally stable anodes with baffles according to this invention.
Figure 2:
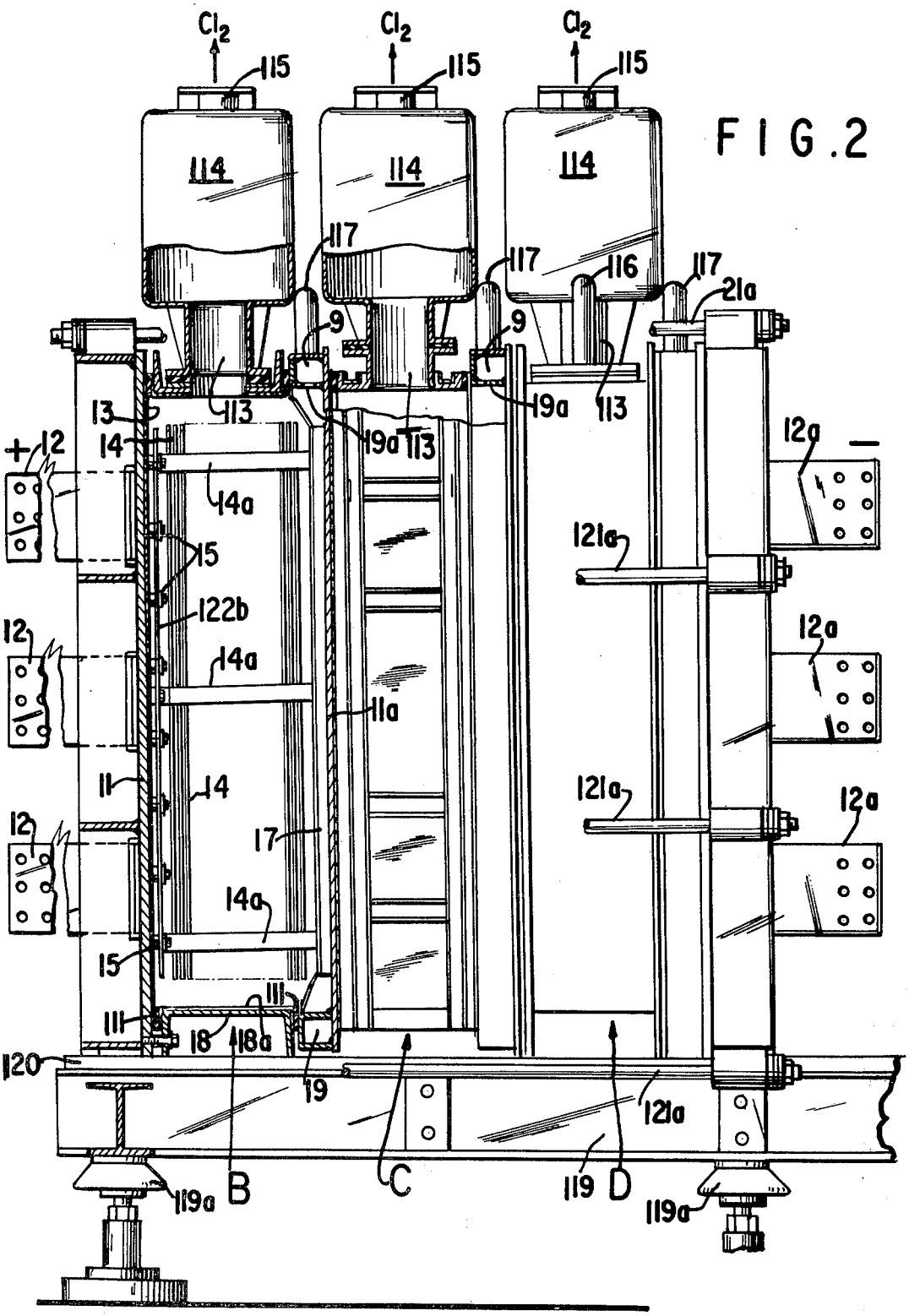
FIG. 2 is a part sectional side view, with parts broken away, of the cell illustrated in FIG. 1.
Figure 3:
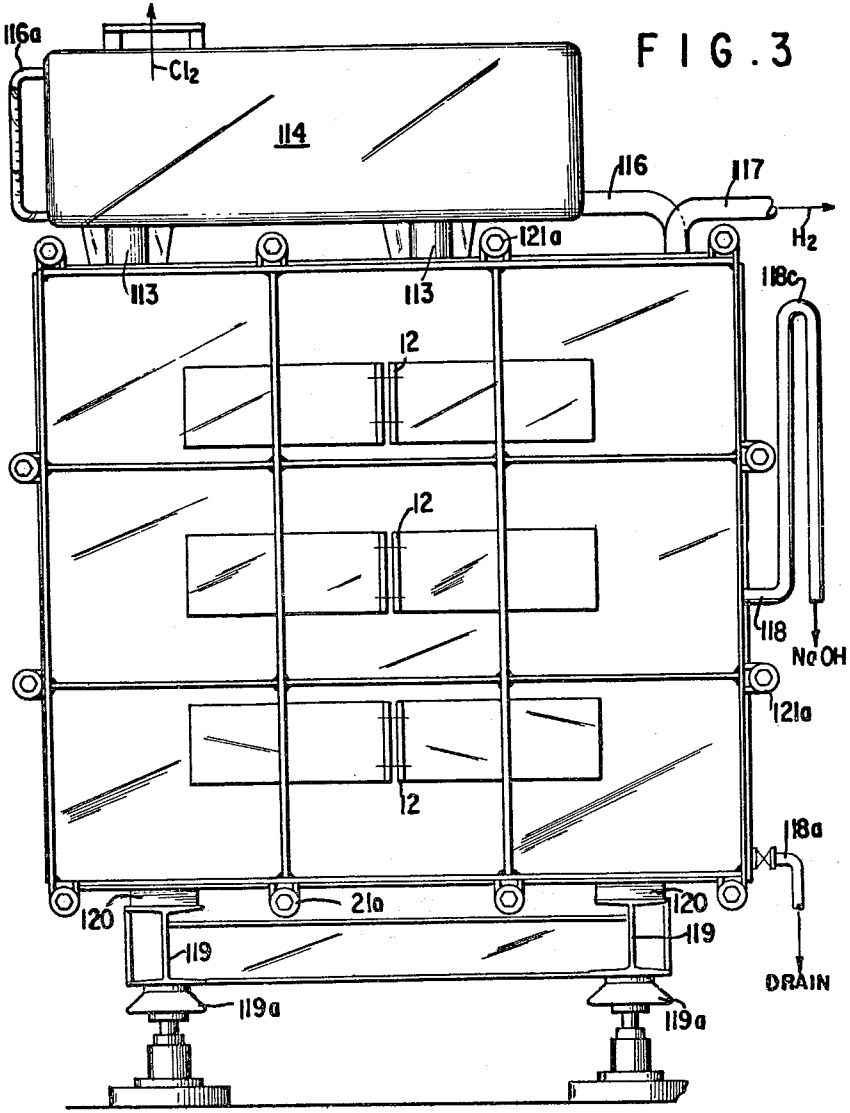
FIG. 3 is an end view of the cell illustrated in FIG. 1.
Figure 4:
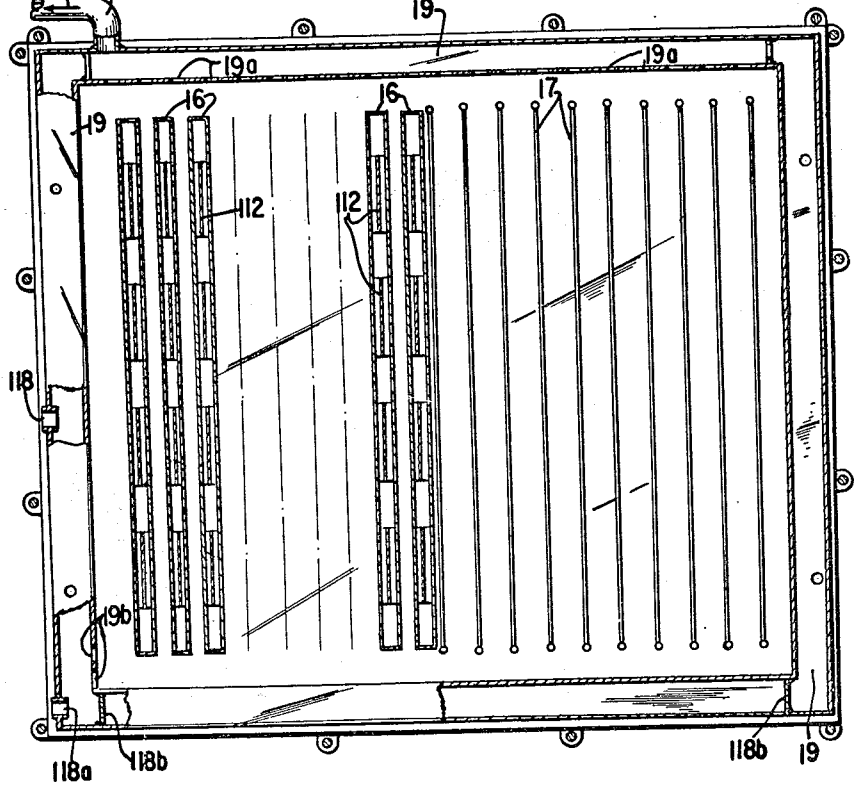
FIG. 4 is a cross sectional view approximately along the line 4 — 4 of FIG. 1.

The steel cathodic end plate 11*a* of each of the bipolar cell units B, C,C and D supports the steel screen cathode waves or fingers 16 on welded steel strips or projections 17 which form the electrical connection between the cathode fingers and the steel plate 11*a* (FIGS. 1 and 3). A spacer box 18 forming the side walls of each rectangular cell unit B, C,C and D, etc., extends between the lining 13 and a squared pipe 19 which surrounds the catholyte compartment 110 formed between the inside of the cathode fingers 16 and the plate 11*a*. The spacer boxes are lined with a titanium lining 18*a* or with a polyester or other lining which is resistant to the anolyte and the corrosive conditions encountered in an electrolytic cell and are provided with matching flanges 18*b*. Rubber gaskets 111 seal the joints between the flanges 18*b*, plates 11 and 11*a* and squared pipe 19, so that a fluid-tight rectangular box-like structure housing the anode rods 14 and the cathode waves 16 is formed between the plates 11 and 11*a* and squared pipe 19 in each of units B, C,C and D of the bipolar cell of FIG. 1. The construction is such that by loosening the tie rods 121*a*, one or more cell units may be removed from a multiple unit cell and replaced with new units without dismantling the other units in the cell. Inside each cathode finger 16, zigzag bent steel reinforcements 112 are welded at spaced intervals to prevent collapse of the screen cathode waves or fingers 16 when an asbestos or other diaphragm material is deposited on the screen cathode fingers under vacuum. The steel screen cathode waves or fingers 16 are closed at the top and bottom, and are covered with a diaphragm material 16*a* (FIGS. 5 and 6), usually either woven asbestos fiber or asbestos flock applied under vacuum. The diaphragm material covers the side walls as well as the top and bottom of cathode waves or fingers 16. The diaphragms are only partially and diagrammatically shown in FIGS. 5 and 6, but it will be understood that the cathode waves 16 are completely covered with diaphragms in the cells. The diaphragms separate the anolyte compartment from the catholyte compartment and keep the gases formed in each of these compartments separate, as is well understood in the diaphragm cell art. In the case of chlorine and caustic soda production from a sodium chloride brine, the diaphragms keep the chlorine released at the anode from mixing with the sodium hydroxide and hydrogen formed at the cathode.

The baffle bars 14*a* supporting the rods 14 from the anode back plates, are welded at their lower edge 14*b* to the anode screen or rods 14 (FIGS. 7 and 8) to deflect the gases (chlorine in the case of sodium chloride electrolysis) which rise along the anode rods 14 away from the anode screens or rods and into the spaces 14*e* at the rear of the anodes and the baffles 14*c* in front of the anodes, which may be valve metal or plastic, are secured at their upper edge 14*d* to the anode screen or rods or to baffles 14*a*. Baffles may be mounted at either the front or back of the anodes, or both, and may be mounted at an angle of 20° to 80° (preferably about 45°) with the anode and rest against the diaphragm at their lower external side 14*c* to deflect the gases (chlorine) which rise along the anodes 14 away from the interelectrodic gap between the anodes and cathodes to prevent disturbance of the diaphragms on the cathode screens 16 and to reduce the amount of gas bubbles in the upper portion of the interelectrodic gap where they tend to reduce the conductivity of the electrolyte in the interelectrodic gap.

When the cell illustrated in FIGS. 1 to 9 is used for the electrolysis of sodium chloride brine to produce chlorine, caustic soda and hydrogen, the electrolyzing current flows through the interelectrodic gap from the anode rods 14 to the cathode waves 16. Chlorine is released at the anode rods, the brine flows through the diaphragms surrounding the cathode waves 16 and caustic soda and hydrogen are formed at the cathode surfaces inside the diaphragms.

Chlorine (or other anodic gases) released at the anode rods 14 rises through the electrolyte, is deflected away from the interelectrodic gap by the baffles 14*c* to the space 14*e* at the back or rear of the anodes and here again is deflected away from the anodes by baffles 14*b*, and escapes through the chlorine passages 113 to brine containers 114 on the top of each cell unit B, C, C, D and flows out of the chlorine outlets 115 to the chlorine recovery system. A pipe connection 116 (FIG. 2) feeds brine from the end of each of the brine containers 114 to the spaces between the rod anodes and cathodes of cell units B, C and D. The feed pipe 116 preferably extends to near the bottom of each of the cell units B, C, D and feeds brine into the cells near the bottom. Sight glasses 116*a* show the brine level in the feed tanks 114.

Sodium hydroxide and hydrogen released at the cathode fingers flows into the catholyte space between diaphragms surrounding the cathode fingers 16 and the end plates 11*a* and into the square pipe 19 (FIGS. 1 and 2) which surrounds and forms part of the catholyte space. The hydrogen flows upward through the holes 19*a* (FIGS. 2 and 4) in the horizontal leg at the top of the squared pipe 19 and out through the hydrogen outlets 117 and the depleted brine containing the sodium hydroxide (about 11 –12%) flows through holes 19*b* (FIG. 1) in the vertical legs of the squared pipe 19 and out of the catholyte outlet 118 (FIGS. 1 and 3). A gooseneck connection 118*c* (FIG. 1) communicating with the catholyte outlet 118 or a telescoping connection (not shown) is adjustable to control the level of the catholyte in the catholyte compartment, preferably by pivoting the gooseneck 118*c* around the outlet pipe 118, so that the catholyte level is always sufficiently below the anolyte level to insure a sufficient flow from the anolyte compartments through the diaphragms into the catholyte compartments. A drain 118*a* permits drainage of the cell units when not in use and partitions 118*b* at each end of the lower horizontal leg of the squared pipe 19 prevent entrance of catholyte into this leg.

The cell units B, C and D are mounted on I-beam supports 119 (FIG. 2), supported on insulators 119*a*. Syenite plates 120 cemented to the upper faces of the I-beams 119 insulate the titanium lined boxes of the cell units B, C and D from the metal I-beams and permit the heavy elements of the cell units to slide on the syenite plates 120 without too great friction during assembly or disassembly of the units. The rectangular side frames 18 and the end plates 11 and 11*a* are held together by tie rods 121*a*, suitably insulated from their surrounding parts by means of insulating bushings, as shown by FIGS. 1 and 5. The temporary bolts 121 shown in FIG. 5 are used only during assembly of the electrolyzer or during replacement of one or more units, to tighten the units together and are taken off before start up of the cell in order to avoid short circuits. During operation of the cell, the tie rods 121*a*, suitably insulated from their surrounding parts, hold the terminal end plates 11 and 11*a* and the rectangular frames 18, forming the electrolyte box of each cell unit, together, with the flanges 18*b* in contact with the sealing gaskets 111. The tie rods 121*a* extend from the positive terminal end plate 11 of unit B to the negative terminal end plate 11*a* of the terminal unit D regardless of the number of intermediate units C in the bipolar cell assembly.

The electrolyzing current flows consecutively from the positive terminal 12 through the end unit B, through the intermediate units C, which vary in number from one to twenty or more depending on the size and use of the bipolar cell, and through the terminal unit D to the negative terminal 12*a* of the circuit. The anode rods 14 or other forms of anodes are preferably made of titanium, suitably coated with an electrocatalytic conductive coating such as a platinum group metal or mixed oxides of titanium and platinum group metal oxides. Other valve metals and other coatings may be used. Rod anodes are illustrated in FIG. 7 and mesh anodes in FIG. 8. The cathode waves or fingers 16 are preferably steel screen material or other ferrous metal similar to the cathode screens now used in diaphragm cells. However, other metals may be used for the anode and cathode waves, depending on the meterial to be electrolyzed and the end products to be produced.

The rod anodes 14 or other forms of anodes and cathode screens 16 are preferably formed as uniform closed end waves, or fingers, nested together and uniformly spaced apart, as illustrated in FIGS. 1, 5 and 6, to provide a substantially uniform interelectrodic gap between the anode surfaces and the cathode surfaces. The anode rods 14 and cathode waves 16 may be moved together by moving the plates 11 and 11*a* with anodes 14 and cathodes 16 mounted thereon horizontally toward each other, to form the nesting anode and cathode waves as illustrated in FIG. 1, 2, 5 and 6, or, by giving a slight taper in the vertical direction to the anode rods and cathode waves, the anode rods and cathodes may be nested together by vertically inserting the cathode waves between the anode rod waves. The anode and cathode waves 14 and 16 need not be as long or as deep as illustrated. Shallower waves may be used, but the deeper waves illustrated provide greater anode and cathode surfaces within cell units of the same square area than shallower waves would provide and the baffles 14*c* on the front of the anode and 14*b* on the back of the anode rods 14, deflect the anodic gases away from the interelectrodic gap and into the electrolyte space 14*e* at the rear of the anodes, to reduce the build up of gas bubbles toward the top of the interelectrodic gap and prevent destruction of the diaphragms, so that the cells can be built higher than if the baffles were not used.

FIG. 9 shows the anode rods 14 mounted on titanium baffles 14*b* by welding or in any other suitable way. The baffles 14*b* are welded to the titanium support strips 14*a* (see also FIG. 2) which are secured by the titanium connectors 15 to the lining plates 13, forming part of each bimetallic partition. Gases rising in the interelectrodic gap formed between the cathode screens 16 and the anode rods 14 pass through the openings between the rods 14 and are deflected by the baffles 14*b* away from the anode rods 14 and into the spaces 14*e* at the rear of the anode rods and away from the interelectrodic gap. Baffles (not shown) may also be mounted between the anodes 14 and the diaphragms 16*a*.

The words "waves" or "fingers" wherever used in the specification or claims are intended to describe the rod wave embodiments of FIGS. 1 to 5 and 7, or sheet, screen or reticulated metal anode waves of FIGS. 8,10 and 11 (hereinafter described).

To insure good electrical connection between the anodic and the cathodic sections of the cell, the anodic metals, such as titanium, tantalum and other valve metals, are preferably sandwich wleded to the steel partition plates 11 and 11*a*, to form bimetallic partitions 11 –13 between the cell units. These partitions constitute the anodic and cathodic pole of any single cell unit. Appropriate intermediate metals, such as copper, lead, etc., may be used to form the sandwich weld, if necessary. Other means, such as vacuum held electrical contact or bolts passing through the bimetallic partitions which will provide good electrical connections between the bipolar elements may be used.

As illustrated in FIG. 6, the anode mesh or rods 14 are in wave form, connected to the titanium lining plate 13 by titanium baffle supports 14*a*, secured to hollow titanium cylinders 15 welded to the plate 13. The cylinders 15 may be screw threaded on the inside and titanium bolts 15*a* may be used to connect the baffle supports 14*a* supporting the baffles 14*b* to which rods 14 are welded to the cylinders 15 and plates 13, using titanium strips 122*b*, where the titanium baffle supports are welded on. The rods or mesh 14 are welded on the baffles 14*b*. The steel cathode waves 16 are connected to the plates 11*a* by steel strips 17 welded to the plates 11*a* and to the trough of the waves 16. The cathode waves are entirely covered with a diaphragm material, such as woven asbestos, asbestos fibers or the like, partially illustrated at 16*a* in FIGS. 5 and 6. In the modified form of connection between the steel plates 11 and the anode waves illustrated in FIG. 6, holes 122 are drilled part way through plates 11 and screw threaded. Hollow titanium bolts 15 are screwed into these holes and, after tightening are welded to the titanium plates 13 to insure a fluid-tight connection, and titanium bolts 15*a* are used to connnct the titanium strips 14*a* with the baffles 14*b* supporting the anode rods 14 and with the hollow titanium bolts 15. Titanium strips 122*b* distribute the current to the anode mesh or to the baffle supports 14*a* and rods 14. The titanium rods 14 may be grooved titanium plates provided with holes and baffles to direct the anodic gases away from the interelectrodic gap, or similar tantalum or other valve metal plates, the rods 14 are provided with a conductive electrocatalytic coating capable of preventing the titanium from becoming passivated, and when used for chlorine production are capable of catalyzing discharge of chloride ions from the surfaces of the anodes. The coating may be on either or on both faces of the anode rods and is preferably on the face of the anode rods 14 facing the cathodes 16.

Diaphragms may be provided on the anode rods 14 or the cathode waves 16 or on both the anode rods and cathode waves.

Figure 10:
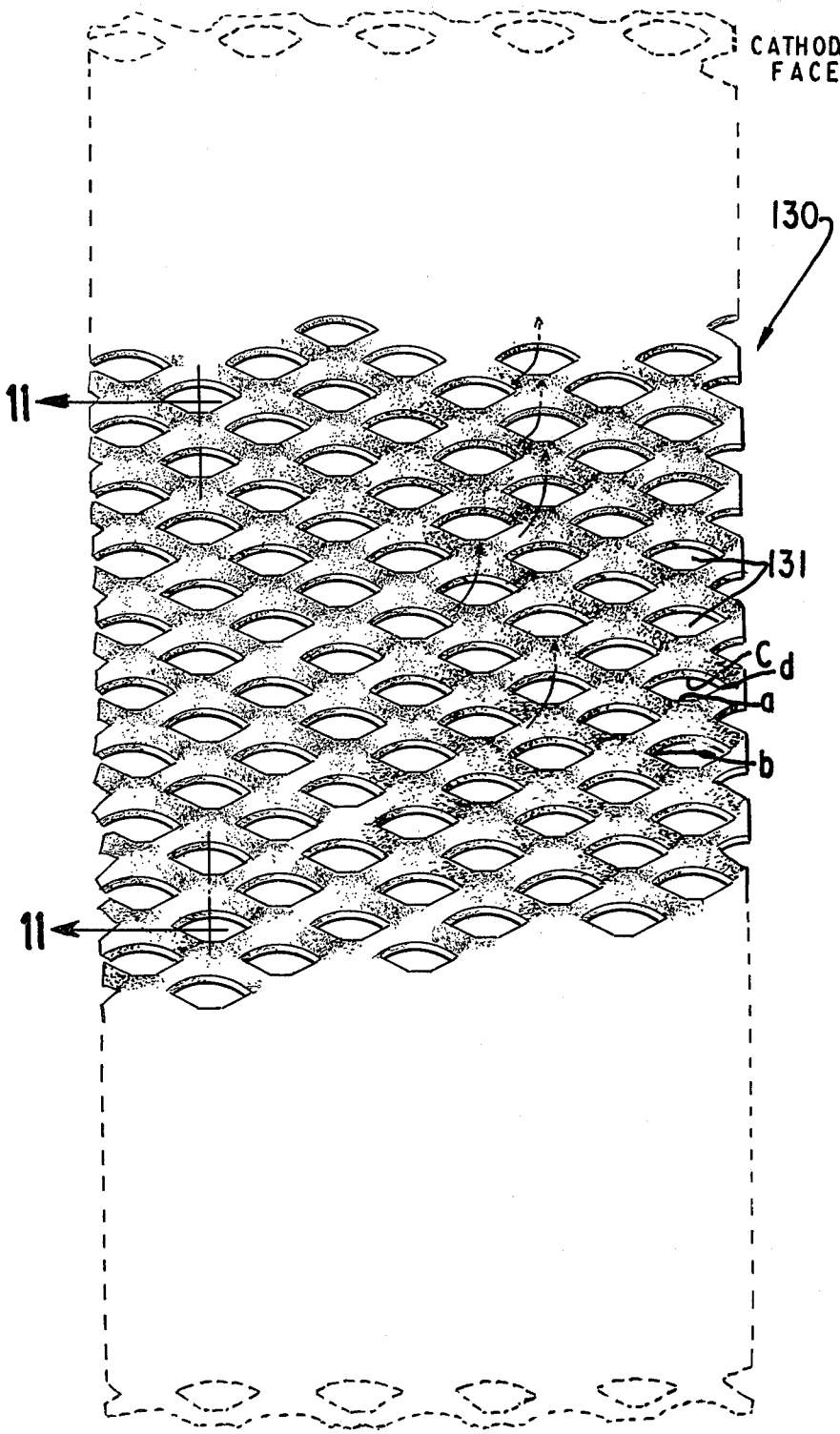
FIG. 10 is a face view of a reticulated metal anode, with diamond-shaped openings in which the upper portion of each diamond is tilted forward of the plane of the anode face and the lower portion of the diamond is tilted rearward of the plane of the anode.
Figure 11:
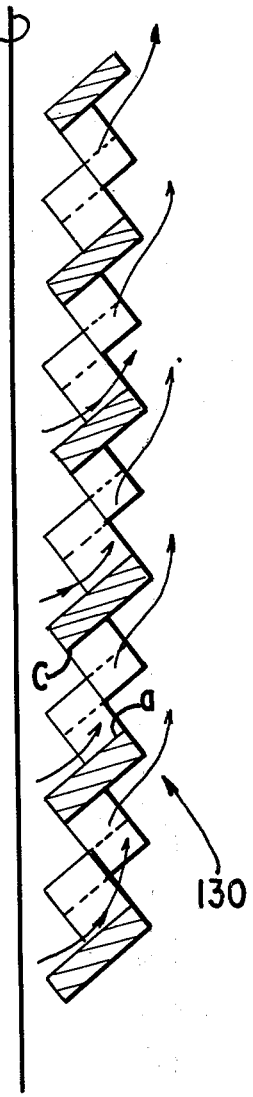
FIG. 11 is a sectional view substantially along the line 11 — 11 of FIG. 10.

FIGS. 10 and 11 illustrate an expanded sheet metal type anode 130, made of titanium, tantalum or other valve metal, provided with an electrically conducting electrocatalytic coating (not shown in the drawings) on at least the face of the anode. The coated face of each anode is mounted opposite a cathode in an electrolyzer cell as illustrated in FIGS. 1 to 9, inclusive. These anodes are provided with diamond-shaped openings 131, in which the bottom central portion *a* of each diamond has been pushed rearwardly of the vertical center plane of the anode, and the top central portion *c* of each diamond pushed forwardly of the vertical center plane of the anode. The corners *b* and *d* of each diamond-shaped opening lie approximately in the vertical plane of the anode. The lower half *b-a-d* of each diamond-shaped opening is tilted or pushed toward the rear of the anode, while the upper half *b-c-d* of each diamond-shaped opening is tilted or pushed toward the front of the anode, so that gases released on the *b-a-d* - half of each diamond-shaped opening pass through said opening to the back or rear of the anode and are deflected rearwardly of the anode by the forwardly tilted upper half *b-c-d* of the anode and into the electrolyte space at the rear of the anode, away from the cathode, as indicated by the arrows in FIGS. 10 and 11. In FIG. 10, the solid portions of the arrows indicate the path of the gases along the legs *b -a-d* of each opening and the dotted portion of the arrows indicate the path of the gases behind the legs *b-c-d* of each opening and away from the cathode, so that most of the gas released along the legs *b-a-d-* which are tilted to the rear of the anode, when released into the diamond-shaped opening, is deflected to the rear of the anode by the legs *b-c-d* which are tilted toward the front of the anode. In this way, most of the gases released along the coated face of the anodes is directed through the opening in the anodes and deflected toward the rear of the anodes, away from the cathodes and their diaphragms.

While diamond-shaped openings 131 have been illustrated in FIGS. 10 and 11, it will be understood that square, round, triangular, hexagonal, or other shaped openings may be provided in anodes 130, with the lower portion of each opening tilted or pushed toward the rear of the anode and the upper portion of each opening tilted or pushed toward the front of the anode to accomplish the same object as described in connection with FIGS. 10 and 11, namely, to pass the gases released at the front of each anode through the opening therein and deflect them to the rear of each anode. The expanded metal type anodes of FIGS. 10 and 11 may be bent into the wave form anodes shown in FIGS. 1 to 9 or may be used flat.

Figure 12:
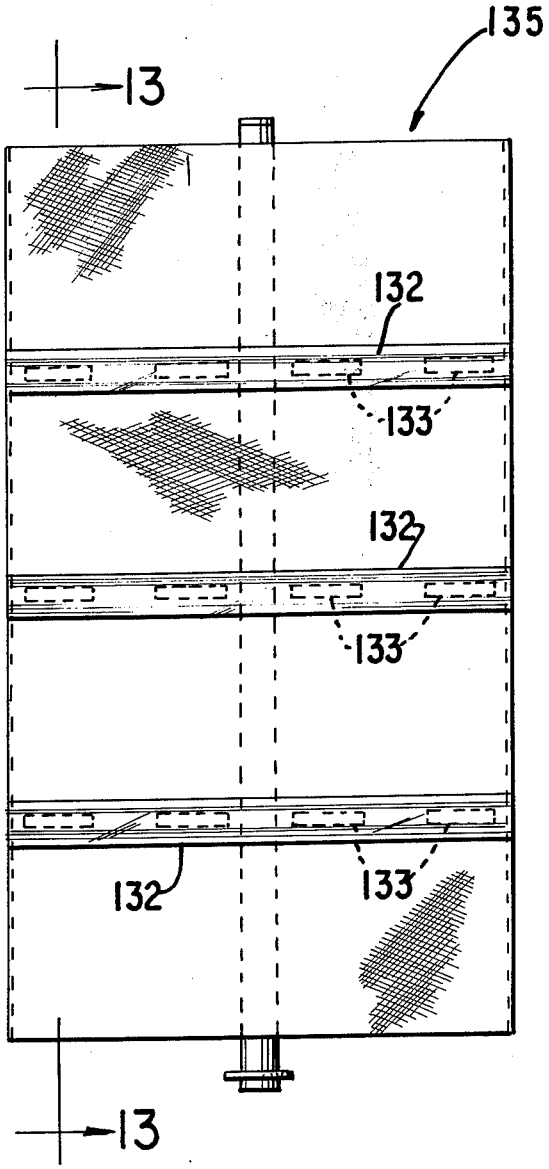
FIG. 12 is a face view of a typical hollow rectangular anode used in monopolor diaphragm electrolysis cells.
Figure 13:
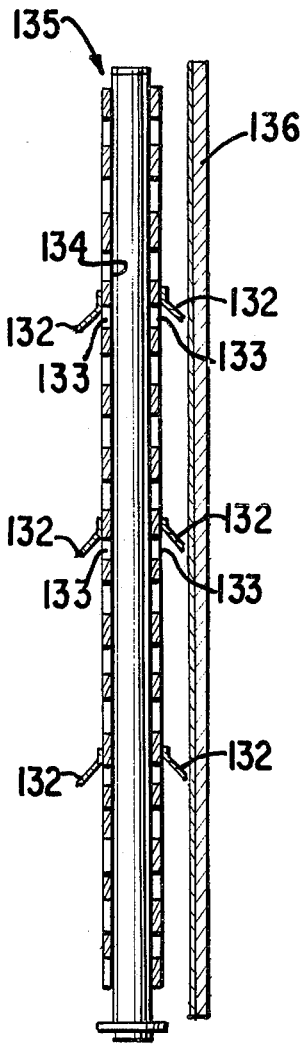
FIG. 13 is a sectional view along the line 13 — 13 of FIG. 12.

FIGS. 12 and 13 illustrate the principles of this invention applied to a typical dimensionally stable anode as used in monopolar diaphragm cells, in which titanium or other suitable deflectors 132 have been applied to the faces 134 of hollow rectangular anodes 135 having screen, rod or reticular metal faces. The anodic gases rising along each face 134 of the anodes 135 are deflected by the baffles 132 into slots 133 in the anode faces and into the hollow interior of the anodes 135 where they rise to the top of the electrolyte through the hollow anodes. The anodes 135 are mounted between diaphragm covered cathodes and the baffles 132 deflect the anodic gases away from the diaphragm covered cathodes 136. The anode construction illustrated in FIGS. 12 and 13 is similar to that illustrated in U.S. Pat. No. 3,707,454, but the anodes of these figures may take diverse forms as now used in monopolar diaphragm cells.

The embodiments of the invention shown in FIGS. 1 to 13 are for illustrative purposes only and various modifications and changes may be made therefrom within the spirit and objects of this invention. The cells illustrated may be used as unipolar single cells or as bipolar multiple cells and while titanium and steel have been described as the metals of construction, various dissimilar metals may be used for the anodes and cathodes of the cell units. Examples of other suitable anode metals are the valve metals, lead, silver and alloys thereof and metals which contain or are coated with $PbO_2$, $MnO_2$, $Fe_3O_4$, etc. and examples of other suitable cathode metals are copper, silver, stainless steel, etc. The metals used should be suitable to resist the corrosive or other conditions encountered in the anolyte or catholyte compartments of the cell when operating on a particular electrolyte. While diaphragms on the cathodes, the anode, or both, will usually be used, the cells can be used without diaphragms for certain purposes, such as chlorate, perchlorate, hypochlorite, and periodate production and for other electroylsis processes in which diaphragm separation of the electrolysis products is not necessary. The diaphragms may be formed of any material suitable for this purpose including asbestos, rubber or resin impregnated asbestos, perm selective membranes, polyethylene, polyvinyl chloride, perfluoro-sulfonic acid membrances and other synthetic or natural membrane or diaphragm materials.

What is claimed is:

1. In an electrolysis cell having substantially vertically mounted dimensionally stable hollow wave anodes and diaphragm covered hollow wave cathodes nested together and forming an interelectrodic gap in wave form therebetween, the method of removing anodic gases from the interelectrodic gap between the hollow wave anodes and the diaphragm covered hollow wave cathodes, which comprises passing the gases released at the anodes substantially vertically upward in the interelectrodic gap along the anode faces, passing the gases through openings in the anode faces, deflecting the gases to the back of the anodes, away from the top of the interelectrodic gap and discharging the gases from the interelectrodic gap and from the top of the space behind the anodes.

2. The method of claim 1, in which the gases are deflected to the back of the anodes by baffles at the back of the anodes.

3. The method of claim 1, in which the gases are deflected to the back of the anodes by baffles at the front of the anodes.

4. The method of claim 1, in which the gases are deflected into a space behind the anodes which is larger than the space between the hollow wave anodes and the hollow wave cathodes.

5. The method of claim 1, in which the gases released at the anodes are passed through diamond-shaped openings in the anodes in which the top of the diamonds are forward of the center longitudinal plane of the anodes and the bottom of the diamonds are rearward of the center longitudinal plane of the anodes and the gases released from the bottom area of the diamond-shaped openings are deflected from the front to the back of the anodes.

6. The method of claim 1, in which the gases released at the anodes travel substantially vertically upward along anode rods and are deflected toward the rear of the anode rods away from the interelectrodic gap by baffles extending away from the interelectrodic gap and upwardly from the anode rods.

7. In an electrolysis cell having substantially vertically mounted dimensionally stable hollow metal anodes and cathodes in nested wave form forming an interelectrodic gap in wave form therebetween, an electrically conducting electrocatalytic coating on said dimensionally stable anodes, facing said gap, a diaphragm in said gap covering said cathodes, passages through the anodes for the escape of anodic gases formed at the anode faces to the rear of the anodes, and deflectors, deflecting the anodic gases upwardly and away from the interelectrodic gap.

8. The cell of claim 7, in which the cell is bipolar and the space behind the hollow anodes and cathodes in wave form is greater than the space in the interelectrodic gap and the anodic gases are deflected into the said greater space.

9. The cell of claim 7, in which the deflectors are at the back of said anodes.

10. The cell of claim 7, in which the deflectors are at the front of said anodes.

11. The cell of claim 7, in which the deflectors are at both the front and back of said anodes.

12. The cell of claim 7, in which the passages through the anodes are diamond-shaped openings and in which the top of the diamonds are forward of the center longitudinal plane of the anodes and the bottom of the diamonds are rearward of the center longitudinal plane of the anodes, so that gases released from the bottom area of the diamond -shaped openings will pass through the diamond-shaped openings and be deflected away from the interelectrodic gap.

13. The cell of claim 7, in which the anodes are formed of substantially vertically arranged rods secured to said deflectors.

14. The cell of claim 13, in which the anode rods are titanium covered with an electrically conducting electrocatalytic coating and the deflector blades are nonconducting.

15. The cell of claim 14, in which the anode rods are from the group consisting of round, oval, square and diamond-shaped rods.

16. In a bipolar electrolyzer, substantially vertically mounted hollow wave anodes and cathodes forming an interelectrodic gap therebetween, vertical grooves in said anodes through which gases released at the anode rise and gas passages through the anodes and deflectors for deflecting the anodic gases away from the interelectrodic gap.

17. The electrolyzer of claim 16, in which the anodes are formed of vertically mounted rods.

18. In an electrolysis cell substantially vertically mounted diemnsionally stable metal anodes with an electrically conducting electrocatalytic coating thereon and diamond-shaped gas passages through the anodes, in which the top of the diamonds are forward of the center longitudinal plane of the anodes and the bottom of the diamonds are rearward of the center longidutinal plane of the anodes, and the longer dimension of the diamond-shaped openings is horizontal, so that gases released from the bottom area of the diamond-shaped opening will pass through the diamond-shaped openings and be deflected away from the interelectrodic gap.

19. In a monopolar diaphragm electrolysis cell having diaphragm covered cathodes and rectangular hollow perforate anodes in vertical rod form in the spaces between the cathodes, the method of removing anodic gases from the interelectrodic gap between the anodes and the diaphragm covered cathodes which comprises passing the gases released at the anodes substantially vertically upward along the rod faces of the anodes, passing a portion of the gases through openings between the rods in the anodes, into the hollow interior thereof, deflecting a portion of the gases away from the interelectrodic gap and into the rectangular hollow space inside the anodes and discharging a portion of the gases from the interior of the hollow space at the top of the rectangular hollow anodes.

20. In a monopolar diaphragm cell having diaphragm covered cathodes and dimensionally stable rectangular hollow perforate metal anodes in vertical rod form between the cathodes, forming an interelectrodic gap between the anodes and cathodes, an electrically conducting electrocatalytic coating containing a platinum group metal oxide on the exterior of the rods of said dimensionally stable rectangular hollow anodes, facing said gap, passages between the rods through the coated anode faces for the escape of anodic gases formed at the anode rod faces to the rear of the anode rod faces and deflector means deflecting the anodic gases into the rectangular hollow spaces in the rear of said anodes and upwardly through rectangular hollow space inside said rod anodes and away from the interelectrodic gap.

21. The method of producing chlorine in a bipolar electrolysis cell having hollow perforate nested valve metal anodes in finger form extending from the acid resistant side of a bimetallic supporting partition which is acid resistant on one side and alkali resistant on the other side, and hollow perforate cathodes in finger form extending from the alkali resistant side of said bimetallic partition, said anode and cathode fingers being nested togather and forming an electrolysis gap in wave form therebetween and having a diaphragm between the anode and cathode fingers, said cell being filled with electrolyte, which comprises passing an electrolysis current from the anode fingers to the cathode fingers, releasing anodic gases at the anode and passing a portion of said gases upwardly through the electrolyte in said electrolysis gap, passing another portion of said gases through the perforate anode fingers and upwardly through the electrolyte behind said anode fingers, discharging both portions of said anodic gases above the top of the anodes and into a gas receiving space at the top of said cell, discharging cathode liquor and cathode gases behind the cathode fingers and maintaining the level of the liquor behind the cathode fingers below the liquor level in the electrolysis gap.

22. The method of claim 21, in which the anode and cathode fingers are more than two meters in height and the anodic gases are deflected away from the electrolysis gap approximately every 2/3rd meter in height and passed through the anode fingers and upwardly behind said anode fingers and are discharged behind said anode fingers, whereby the anode and cathode fingers can be made two to four times higher than normal and the accumulation of gas bubbles in the electrolysis gap and the destruction of the diaphragms in the electrolysis gap is reduced.

* * * * *

UNITED STATES PATENT OFFICE

CERTIFICATE OF CORRECTION

Patent No. 3,930,981 Dated January 6, 1976

Inventor(s) Oronzio de Nora et al.

It is certified that error appears in the above-identified patent and that said Letters Patent are hereby corrected as shown below:

Col. 7, line 40 "wleded" should be -- welded --

Col. 8, line 56 amendment of June 12, 1975 to page 19, line 14, not inserted. This amendment reads as follows:

-- As shown in Fig. 10 the longer dimension of the diamond shaped openings is horizontal --

Col. 11, line 19 (claim 18, third line from bottom) "opening" should be -- openings --

Signed and Sealed this eighth Day of June 1976

[SEAL]

Attest:

RUTH C. MASON
Attesting Officer

C. MARSHALL DANN
Commissioner of Patents and Trademarks